US011708678B2

(12) United States Patent
Hindbo

(10) Patent No.: US 11,708,678 B2
(45) Date of Patent: Jul. 25, 2023

(54) SYSTEMS AND METHODS FOR SUPPORTING A STRUCTURE UPON COMPRESSIBLE SOIL

(71) Applicant: Cyntech Anchors Ltd., Rocky View (CA)

(72) Inventor: Brandon Jens Hindbo, Rocky View (CA)

(73) Assignee: CYNTECH ANCHORS LTD, Rocky View (CA)

( * ) Notice: Subject to any disclaimer, the term of this patent is extended or adjusted under 35 U.S.C. 154(b) by 0 days.

(21) Appl. No.: 16/719,514

(22) Filed: Dec. 18, 2019

(65) Prior Publication Data

US 2021/0189679 A1 Jun. 24, 2021

(51) Int. Cl.

| | |
|---|---|
| ***E02D 27/01*** | (2006.01) |
| ***E02D 27/08*** | (2006.01) |
| ***E02D 5/56*** | (2006.01) |
| ***E02D 7/22*** | (2006.01) |

(52) U.S. Cl.

CPC ..... *E02D 27/01* (2013.01); *E02D 5/56* (2013.01); *E02D 7/22* (2013.01); *E02D 27/08* (2013.01)

(58) Field of Classification Search

CPC combination set(s) only.
See application file for complete search history.

(56) References Cited

U.S. PATENT DOCUMENTS

| | | | | |
|---|---|---|---|---|
| 4,040,260 | A | 8/1977 | Pryke | |
| 5,904,447 | A | 5/1999 | Sutton et al. | |
| 5,919,005 | A | 7/1999 | Piper | |
| 6,665,990 | B1 * | 12/2003 | Cody | E02D 27/42 405/244 |
| 7,112,012 | B2 | 9/2006 | Whitsett | |
| 8,272,810 | B2 | 9/2012 | Dimitrijevic | |
| 8,360,689 | B2 | 1/2013 | Maher et al. | |
| 8,506,207 | B2 | 8/2013 | Lutenegger et al. | |
| 8,845,236 | B1 | 9/2014 | Dosdourian et al. | |
| 9,416,513 | B2 | 8/2016 | Kemp et al. | |
| 9,435,094 | B2 | 9/2016 | Collis | |
| 9,598,831 | B2 | 3/2017 | Lutenegger et al. | |
| 9,783,949 | B2 | 10/2017 | Arya | |

(Continued)

FOREIGN PATENT DOCUMENTS

| | | | |
|---|---|---|---|
| AU | 2016100944 | B4 | 1/2017 |
| AU | 2015261689 | A1 | 6/2017 |

(Continued)

OTHER PUBLICATIONS

Extended European Search Report dated May 20, 2021 for Application No. 20211401.3.

*Primary Examiner* — Kyle Armstrong
(74) *Attorney, Agent, or Firm* — Billion & Armitage

(57) ABSTRACT

Embodiments of the present disclosure relate to a system for reinforcing compressible soil strata. The system comprises at least one helical rigid-inclusion comprising a elongate body, a top member secured to one end of the elongate body, and at least one lower helically-formed member secured to the end of the elongate body opposite to the top member, and a load transfer platform configured to transfer at least a portion of a load from an overlying surface to the helical rigid-inclusion. Embodiments of the present disclosure also relate to methods of installing the system for reinforcing compressible soil.

19 Claims, 13 Drawing Sheets

(56) References Cited

U.S. PATENT DOCUMENTS

| | | | | |
|---|---|---|---|---|
| 9,869,070 | B2 | 1/2018 | Green et al. | |
| 9,976,275 | B2 | 5/2018 | Thurner et al. | |
| 10,024,019 | B1 * | 7/2018 | Hunter | E02D 5/56 |
| 10,024,020 | B2 | 7/2018 | Fuller | |
| 10,077,893 | B1 | 9/2018 | Abraham | |
| 10,119,237 | B2 | 11/2018 | Vasey | |
| 10,161,096 | B2 | 12/2018 | Masse et al. | |
| 10,220,918 | B2 | 3/2019 | Knapp et al. | |
| 10,221,538 | B2 | 3/2019 | Lutenegger et al. | |
| 2004/0163357 | A1 * | 8/2004 | Gregory | E02D 27/50 52/747.12 |
| 2013/0160380 | A1 | 6/2013 | Atchley | |
| 2016/0194833 | A1 * | 7/2016 | White | E02D 5/34 238/2 |
| 2017/0130416 | A1 | 5/2017 | Wilson et al. | |
| 2017/0183839 | A1 | 6/2017 | Reusing et al. | |
| 2017/0218590 | A1 | 8/2017 | Raposo et al. | |
| 2017/0370067 | A1 | 12/2017 | Kettner | |
| 2018/0030681 | A1 | 2/2018 | Stroyer | |
| 2018/0087231 | A1 | 3/2018 | Masula et al. | |
| 2018/0148901 | A1 | 5/2018 | Kemp et al. | |
| 2018/0216305 | A1 | 8/2018 | Nakano | |
| 2018/0327979 | A1 * | 11/2018 | Szekely | E01C 3/00 |
| 2019/0153684 | A1 | 5/2019 | Uezu | |
| 2019/0271131 | A1 * | 9/2019 | Perko | E02D 5/36 |

FOREIGN PATENT DOCUMENTS

| | | | | |
|---|---|---|---|---|
| DE | 4236766 | A1 * | 5/1994 | E01B 2/006 |
| DE | 29806444 | U1 * | 7/1998 | E04H 13/003 |
| DE | 29923797 | U1 | 5/2001 | |
| DE | 102008022478 | B3 | 10/2009 | |
| EP | 0947634 | A1 | 10/1999 | |
| GB | 2409873 | A | 7/2005 | |
| GB | 2506298 | B | 12/2014 | |
| GB | 2529424 | A * | 2/2016 | E01B 2/006 |
| GB | 2563063 | A | 12/2018 | |
| WO | 2013067584 | A1 | 5/2013 | |
| WO | 2016077891 | A1 | 5/2016 | |
| WO | 2018076054 | A1 | 5/2018 | |
| WO | 2018090093 | A1 | 5/2018 | |
| WO | 2019056058 | A1 | 3/2019 | |

* cited by examiner

FIG. 12A
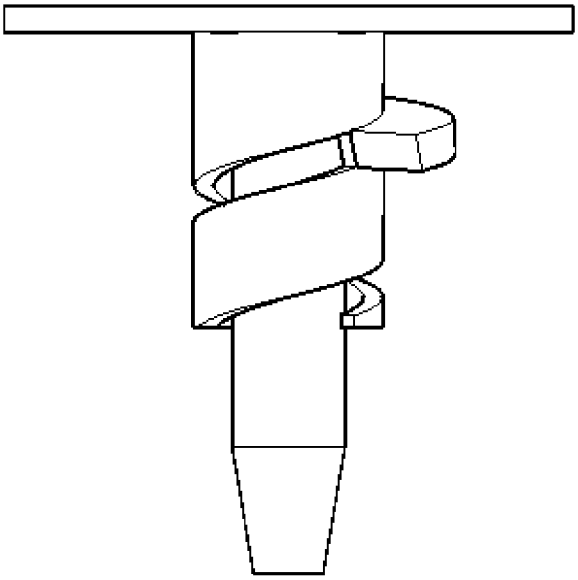
FIG. 12B
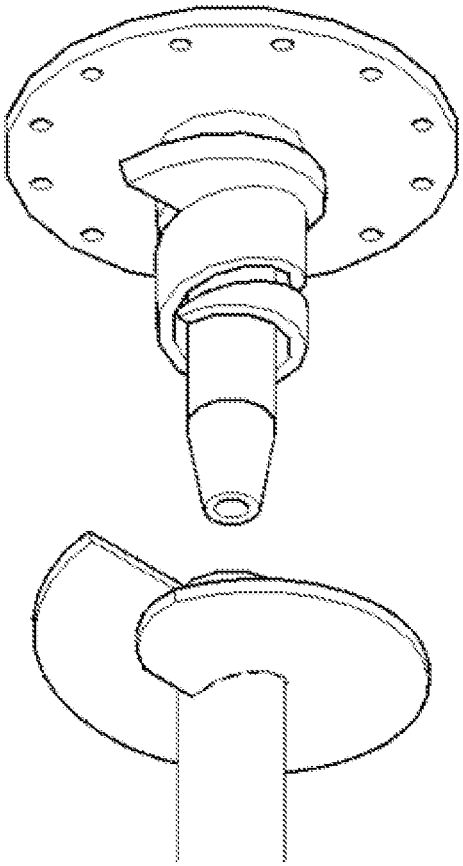
FIG. 12

SYSTEMS AND METHODS FOR SUPPORTING A STRUCTURE UPON COMPRESSIBLE SOIL

TECHNICAL FIELD

The present disclosure generally relates to ground improvements. In particular, the present disclosure relates to ground improvements that comprise at least one apparatus, at least one system and at least one method for supporting structures upon compressible soil.

BACKGROUND

A common method of ground improvement is the use of rigid inclusions. Traditional rigid inclusions are high modulus grout or cemented aggregate elements that are used to reinforce compressible soils and increase the load-bearing capacity of said soils by transferring loads to a firm, underlying stratum or bearing layer. Unlike piles, rigid inclusions do not have direct structural connections to any footings or other structures above them. If the stratum close to the surface is inadequate at transferring the load to the rigid inclusion therebelow, load transfer platforms or layers may be useful.

Typically, rigid inclusions are installed using a tool that forms an elongate hole within the ground and then injects the grout or cement aggregate mixture into the hole. The stabilizing performance of a rigid inclusion may be increased by increasing the diameter of the rigid inclusion within the load transfer platform and within the bearing layer. However, these known installation methods create rigid inclusions with a constant diameter along its length. Therefore, as a rigid inclusion is made larger, costs can increase without any increase in stabilizing performance Additionally, rigid inclusions require extensive time to reach full design strength and generally cannot easily be installed in rain or extreme cold conditions. Rigid inclusions have other shortcomings, such as when cement is used this can result in increased carbon dioxide production. Furthermore, rigid inclusions can only be removed by large-scale excavation.

Because of the many limitations of existing grout and cemented rigid inclusions, improved methods of reinforcing compressible soil may be desirable.

SUMMARY

Embodiments of the present disclosure relate to at least one apparatus, at least one system and at least on method for reinforcing a compressible soil stratum.

Some embodiments of the present disclosure relate to a helical rigid-inclusion that comprises an elongate body, a top member secured to one end of the elongate body, and at least one lower helically-formed member secured to an end of the elongate body, opposite to the top member. The top member may be helically arranged about the one end of the elongate body or the top member may be substantially planar.

Some embodiments of the present disclosure relate to a system that comprises at least one helical rigid-inclusion that comprises an elongate body, a top member secured to one end of the elongate body, and at least one lower helically-formed member secured to an end of the elongate body, opposite to the top member. The system may further comprise a load transfer platform configured to transfer at least a portion of a load force generated from an object resting upon an overlying surface to the at least one helical rigid-inclusion. In some embodiments of the present disclosure, the system further comprises an extension member that is reversibly connectible to the at least one helical rigid-inclusion, and a second at least one helical rigid-inclusion that is reversibly connected to the second elongate body.

Some embodiments of the present disclosure relate to a system that includes more than one helical rigid-inclusion that are arrangeable in an array. The array can be of various dimensions and shapes (from a top-plan view) depending upon the design and specifications of the structure that will be supported by the array.

Some embodiments of the present disclosure relate to a method of installing a system for reinforcing compressible soil. The method comprises the steps of: positioning a rotary drive mechanism above a surface at a desired location for installing a helical rigid-inclusion; attaching the helical rigid-inclusion to the rotary drive mechanism; exerting a torsional force from the rotary drive mechanism into the helical rigid-inclusion to initiate downward advancement below the surface; disconnecting the helical rigid-inclusion from the rotary drive mechanism and retracting the rotary drive mechanism to a location above the surface; repeating the previous steps until each helical rigid-inclusion is installed in a desired array; and installing a load transfer platform above the compressible soil, the load transfer platform configured to transfer a load force generated from an object resting on the surface to the helical rigid-inclusions of the array below the surface.

Without being bound by any particular theory, the embodiments of the present disclosure may reduce the "negative skin friction" or "downdrag" force experienced by existing rigid inclusions. Existing rigid inclusions may have a relatively large diameter and a comparatively high friction coefficient due to the gout/concrete column. In contrast, embodiments of the present disclosure relate to rigid inclusions with a relatively smaller diameter and a lower adhesion with the surrounding soil. The embodiments of the present disclosure can also reduce the cost and increase installation efficiencies compared to existing rigid inclusion processes in part because specialized equipment are not required for installation. The rigid inclusions of the present disclosure are configured to transfer the force of a load to a more rigid bearing layer therebelow rather than allowing the force to be transferred to a compressible layer, which could result in excessive settlement or instability. Furthermore, the embodiments of the present disclosure relate to arrays of rigid inclusions that can be arranged in arrays to provide greater support objects of various shapes and sizes.

BRIEF DESCRIPTION OF THE DRAWINGS

These and other features of the present disclosure will become more apparent in the following detailed description in which reference is made to the appended drawings. The appended drawings illustrate one or more embodiments of the present disclosure by way of example only and are not to be construed as limiting the scope of the present disclosure.

FIG. 1 shows a side elevation view of two helical rigid-inclusions for use with ground improvement systems, according to embodiments of the present disclosure, wherein

FIG. 5 shows a ground improvement system, according to embodiments of the present disclosure, wherein the system comprises an array of helical rigid-inclusions, wherein

FIG. 6 shows another ground improvement system, according to embodiments of the present disclosure, wherein the system comprises an array of helical rigid-inclusions, wherein

FIG. 7 shows another ground improvement system, according to embodiments of the present disclosure, wherein the system comprises an array and a sub-array of helical rigid-inclusions, wherein

FIG. 8 shows another ground improvement system, according to embodiments of the present disclosure, wherein the system comprises an array and a sub-array of helical rigid-inclusions, wherein

FIG. 9 shows another ground improvement system, according to embodiments of the present disclosure, wherein the system comprises an array of helical rigid-inclusions, wherein

FIG. 10 shows another ground improvement system, according to embodiments of the present disclosure, wherein the system comprises an array of helical rigid-inclusions, wherein

FIG. 12 shows a drive tool, according to embodiments of the present disclosure, for use with various of the helical rigid-inclusions shown herein, wherein FIG. 12A shows a side elevation view of the drive tool; and, FIG. 12B shows a lower isometric view of the drive tool with a helical rigid-inclusion.

DETAILED DESCRIPTION

Definitions

Unless defined otherwise, all technical and scientific terms used herein have the same meaning as commonly understood by one of ordinary skill in the art to which this disclosure belongs.

As used herein, the term "about" refers to an approximately +/−10% variation from a given value. It is to be understood that such a variation is always included in any given value provided herein, whether or not it is specifically referred to.

Embodiments of the present disclosure will now be described with reference to FIG. 1 through FIG. 13, which show apparatus, systems and methods for supporting structures upon weak, compressible soil.

Figure 1A:
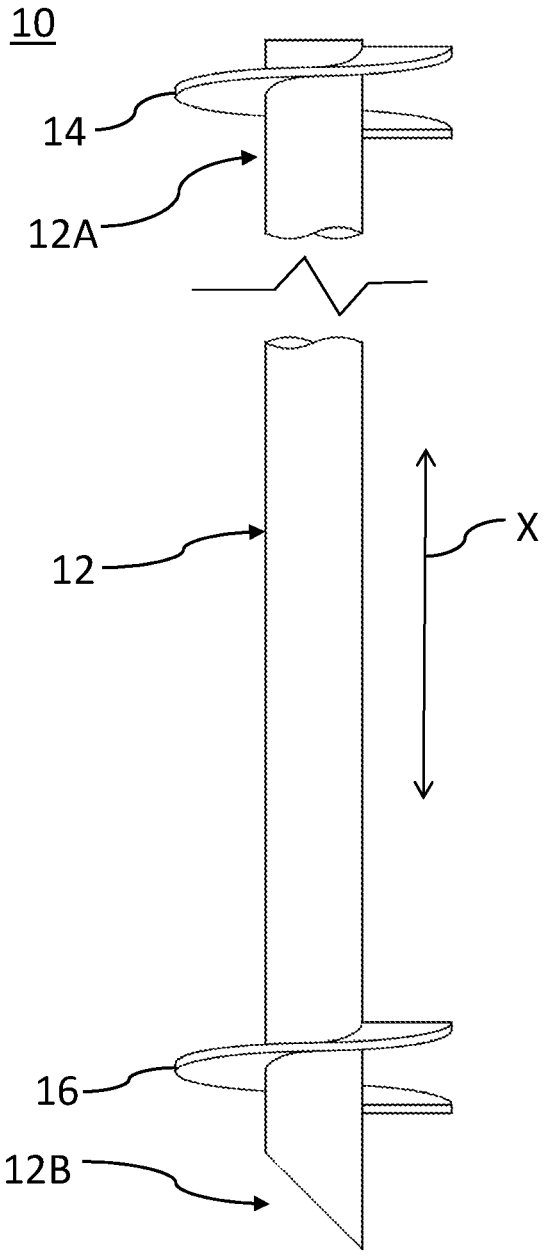
FIG. 1A shows a first helical rigid-inclusion.

FIG. 1A shows one embodiment of a helical rigid-inclusion 10 apparatus that may be used in ground improvement systems of the present disclosure. The helical rigid-inclusion 10 comprises an elongate body 12 with a first end 12A and an opposite second end 12B. Upon insertion into the ground, the first end 12A may define a top end that is closer to the surface and the second end 12B may define a second end that is further from the surface. The helical rigid-inclusion 10 may further comprise a top member 14 that is secured to the first end 12A of the elongate body 12, and at least one second lower helically-formed member 16 that is secured to the second end 12B of the elongate body 12 that is opposite to the top member 14. The elongate body 12 may have a cross-sections shape that is round, square, or another suitable shape and the elongate body 12 may be substantially hollow, or not. In some embodiments of the present disclosure, the elongate body 12 has a circular cross-sectional shape with an outer diameter ranging from about 1.5 inches to about 18 inches (note, one inch is equal to about 2.54 centimeters and one foot is equal to 12 inches). In some embodiments of the present disclosure, the elongate body 12 has an outer diameter of about 7 inches. The elongate body 12, when substantially hollow, can have a wall thickness of about 0.1 inches to about 1.2 inches. In some embodiments of the present disclosure, the wall thickness of the elongate body 12, when substantially hollow, is about 0.362 inches. In some embodiments of the present disclosure, the elongate body 12, the top member 14 and the at least one lower helically-formed member 16 are made of steel; however, other materials with similar physical properties may be suitable also. In some embodiments of the present disclosure, the top member 14 and the at least one lower helically-formed member 16 may be secured to the elongate body 12 by welding or other known techniques.

In some embodiments of the present disclosure, the top member 14 and the at least one lower helically-formed member 16 are secured to the elongate body 12 in a configuration so that they both trace along the same cut line into the soil thereby minimizing soil disturbance when advancing the helical rigid-inclusion 10 into and through the soil. For example, the top member 14 and the lower member 16 may be configured at an equal pitch as measured by the vertical distance from a leading edge to a trailing edge of the top member 14. In some embodiments of the present disclosure, the top member 14 and the at least one lower helically-formed member 16 are positioned along the elongate body 12 at increments that are evenly divisible by the desired pitch. In some embodiments of the present disclosure, the end of the elongate body 12 that leads the advancement below the surface may be beveled or otherwise pointed so as to facilitate inserting the helical rigid-inclusion 10 into the ground.

Figure 2:
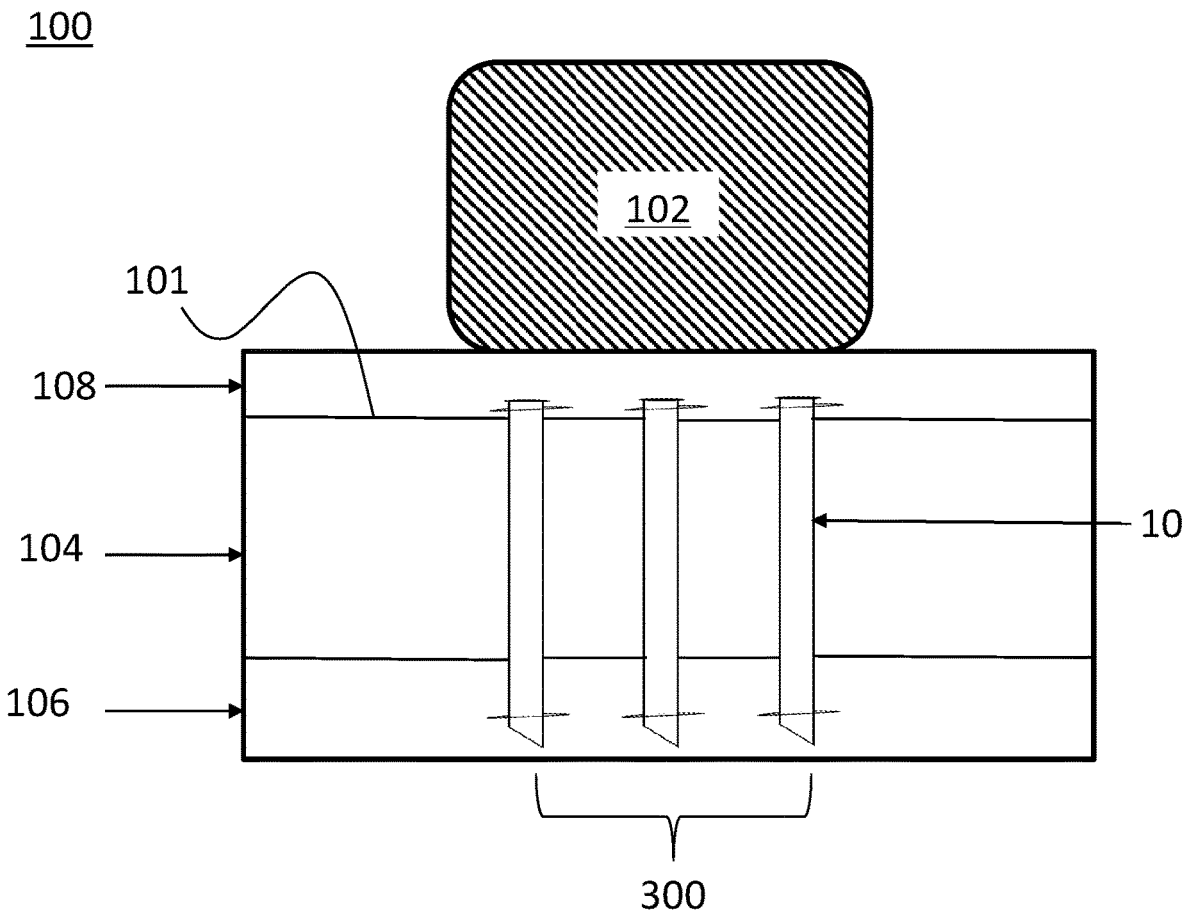
FIG. 2 shows a ground improvement system, according to embodiments of the present disclosure.

The diameter of the top member 14 may be selected to support a portion of a load force that is generated by an object 102 that is supported upon the surface 101 (shown in FIG. 2). In some embodiments of the present disclosure, the top member 14 and the at least one lower helically-formed member 16 can have a diameter ranging from about 7 inches to about 45 inches and a thickness of about 0.2 inches to about 2 inches. In some embodiments of the present disclosure, the top member 14 and the at least one lower helically-formed member 16 have a diameter of about 20 inches and a thickness of about 0.625 inches. The top member 14 and the at least one lower helically-formed member 16 can be substantially the same dimensions, or not.

Figure 1B:
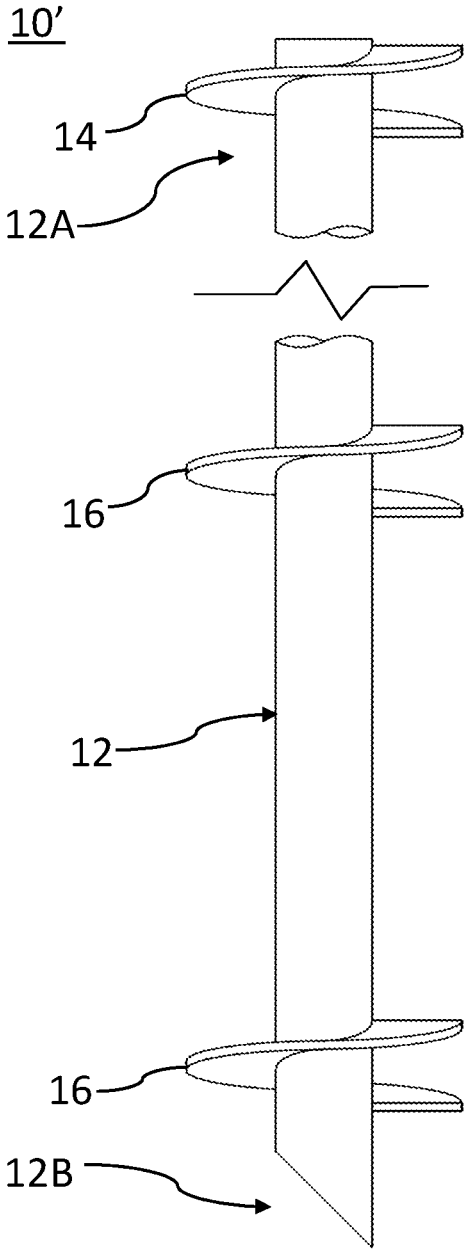
FIG. 1B shows a second helical rigid-inclusion.

As illustrated in FIG. 1A, in some embodiments of the present disclosure, the at least one lower helically-formed member 16 is a single helically formed member configured to cut through the soil at a constant pitch. In other embodiments of the present disclosure, the at least one lower helically-formed member 16 can be 2, 3 or more helically-formed members configured to cut through the soil at a constant pitch. FIG. 1B shows another embodiment of a helical rigid-inclusion 10' that includes multiple lower helically-formed members 16. If there are more than one lower helically-formed members 16, they can be substantially the same dimensions, or not. The person skilled in the art will appreciate that the references below to the helical-rigid inclusion 10 are also references to the helical rigid-inclusions 10'.

FIG. 2A shows a ground improvement system 100 according to embodiments of the present disclosure. The system 100 comprises at least one helical rigid-inclusion 10 and the object 102, wherein the object 102 is positioned upon and at least partially supported by the surface 101 that is located above a compressible layer 104. Although FIG. 2 shows three helical rigid-inclusions 10, as discussed further below, the present disclosure is not limited to this number. In some uses of the system 100, the object 102 is a building, a structure, a warehouse, a road-supporting embankment, a support structure for a bridge, a tank and the like. The object 102 may generate a constant load force, a transient load force, or a combination of both. The load force generated by the object 102 may be focused in a specific area or it may be diffused across a broader area or the object 102 may generate more than one load force for example if the object 102 is a warehouse and the contents of the warehouse are concentrated within an area therein. The object 102 can have a footprint of between about 110 square feet to about 1,000,000 square feet, or larger (a foot is equal to 12 inches). As will be appreciated by those skilled in the art, the size and shape of the object 102 can determine the number of the helical rigid-inclusions 10 used and the arrangement of the helical rigid-inclusions 10 used, which is referred to herein as an array. The array can be designed to be circular, rectangular, square, or any shape (form a top-plan view) and include a distribution of helical rigid-inclusions 10 that are desired to support the object 102 upon the surface 101 and the compressible layer 104 therebelow. The helical rigid-inclusions 10 are configured to transfer at least a portion of the load force generated by the weight of the object 102 upon the surface 101 to the bearing layer 106 through the helical rigid-inclusions 10. In some embodiments of the present disclosure, this transfer of at least a portion of the load force to the bearing layer 106 may partially, or substantially completely, bypass transferring any of the force to the compressible layer 104. This transfer of at least a portion of the force to the bearing layer 106 provides greater stability of the object 102 upon the surface 101.

In some embodiments of the present disclosure, the object 102 may be on a shallow foundation (e.g. concrete footings), or not. In some embodiments of the present disclosure, the object 102 may be positioned upon a concrete slab-on-grade, or not.

In some embodiments of the present disclosure, the system 100 further comprises a load transfer platform 108 that is positioned between the compressible layer 104 and the object 102. The load transfer platform 108 may be useful when the stratum close to the ground surface is of insufficient integrity or physical strength to support the object 102. In some embodiments of the present disclosure, the load transfer platform 108 may have a thickness of between about 1 foot and about 5 feet. In some embodiments of the present disclosure, the load transfer platform 108 comprises a form of a compacted granular material. In some embodiments of the present disclosure, the compacted granular material is gravel, recycled asphalt, other suitable materials, or combinations thereof. In some embodiments of the present disclosure, the load transfer platform 108 further comprises layers of embedded geotextile, geosynthetic material, steel mesh reinforcement, or a combination thereof.

Figure 3:
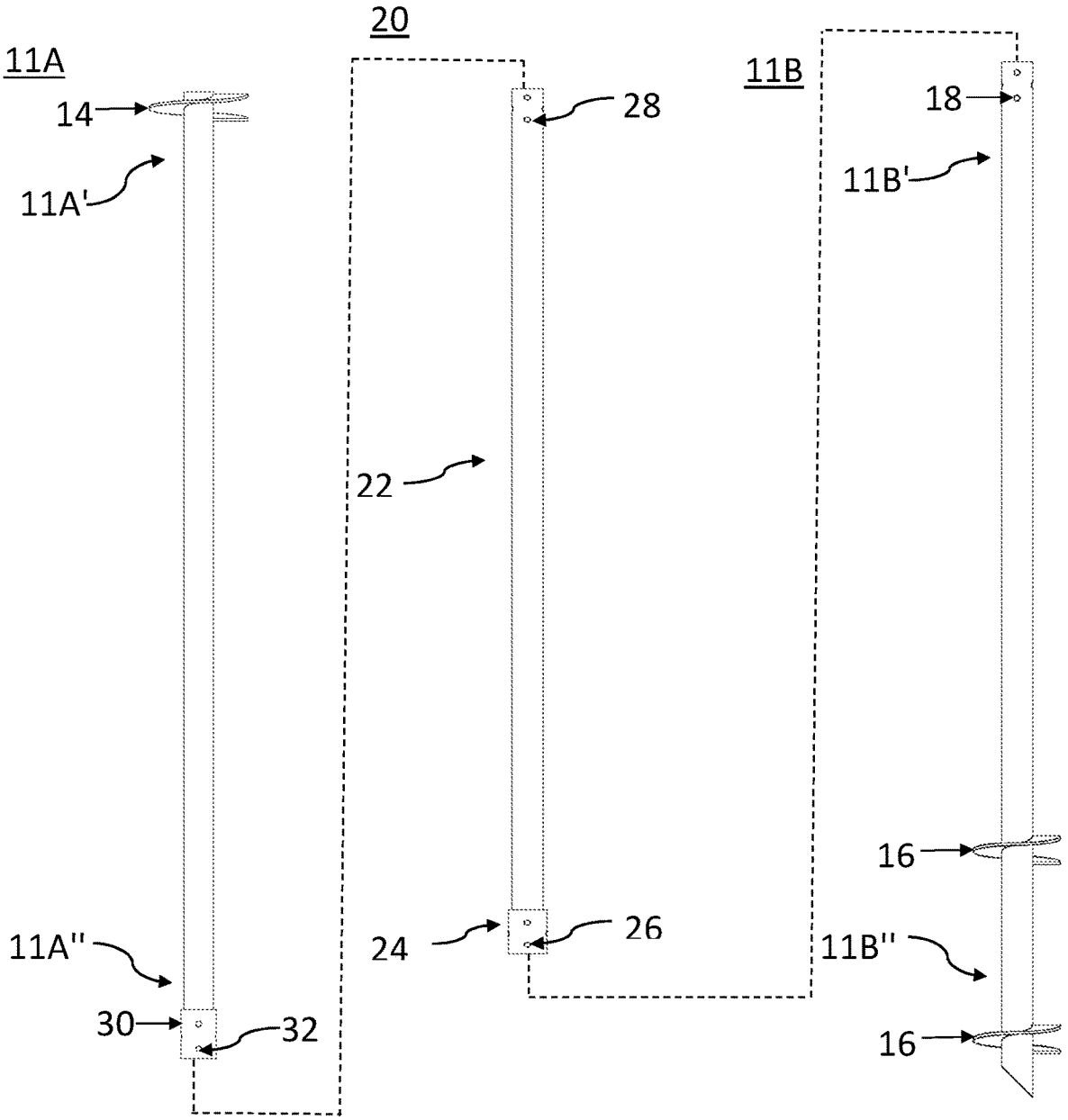
FIG. 3 shows an extension member for use with a helical rigid-inclusion, according to embodiments of the present disclosure, which can be used to extend the effective length of the helical rigid-inclusion to a target depth.

In some instances, the compressible layer 104 can be of such a thickness that the bearing layer 106 is at a depth that exceeds the length of the at least one helical rigid-inclusion 10. In these instances, the helical rigid-inclusion 10/10' may further comprise an extension member 20 (as shown in FIG. 3) that is connectible to both a downward facing end of an upper helical rigid-inclusion member 11A and an upward-facing end of a lower helical rigid-inclusion member 11B. In some embodiments of the present disclosure, the extension member 20 comprises a central shaft 22, which may be substantially hollow or not, and a sleeve 24 located at one end of the hollow central shaft 22. The sleeve 24 defines at least one aperture 26 that can be used to connect the extension member 20 to the upward-facing end of the lower helical rigid-inclusion member 11B. The central shaft 22 comprises at least one aperture 28 at an end opposite the sleeve 24 that can be used to connect the extension member 20 to the downward-facing end of upper helical rigid-inclusion member 11A for example by inserting one or more connection members through the at least one apertures 26, 28. As will be appreciated by those skilled in the art, the extension member 20 can be connected to the upper member 11A and the lower member 11B by various other approaches and methods. In some embodiments of the present disclosure, the extension member 20 is made of steel or another material of similar physical properties.

The extension member 20 can be connected to the at lower helical rigid-inclusion member 11B when the lower helical rigid-inclusion member 11B has already been installed below ground, or not.

Figure 4:
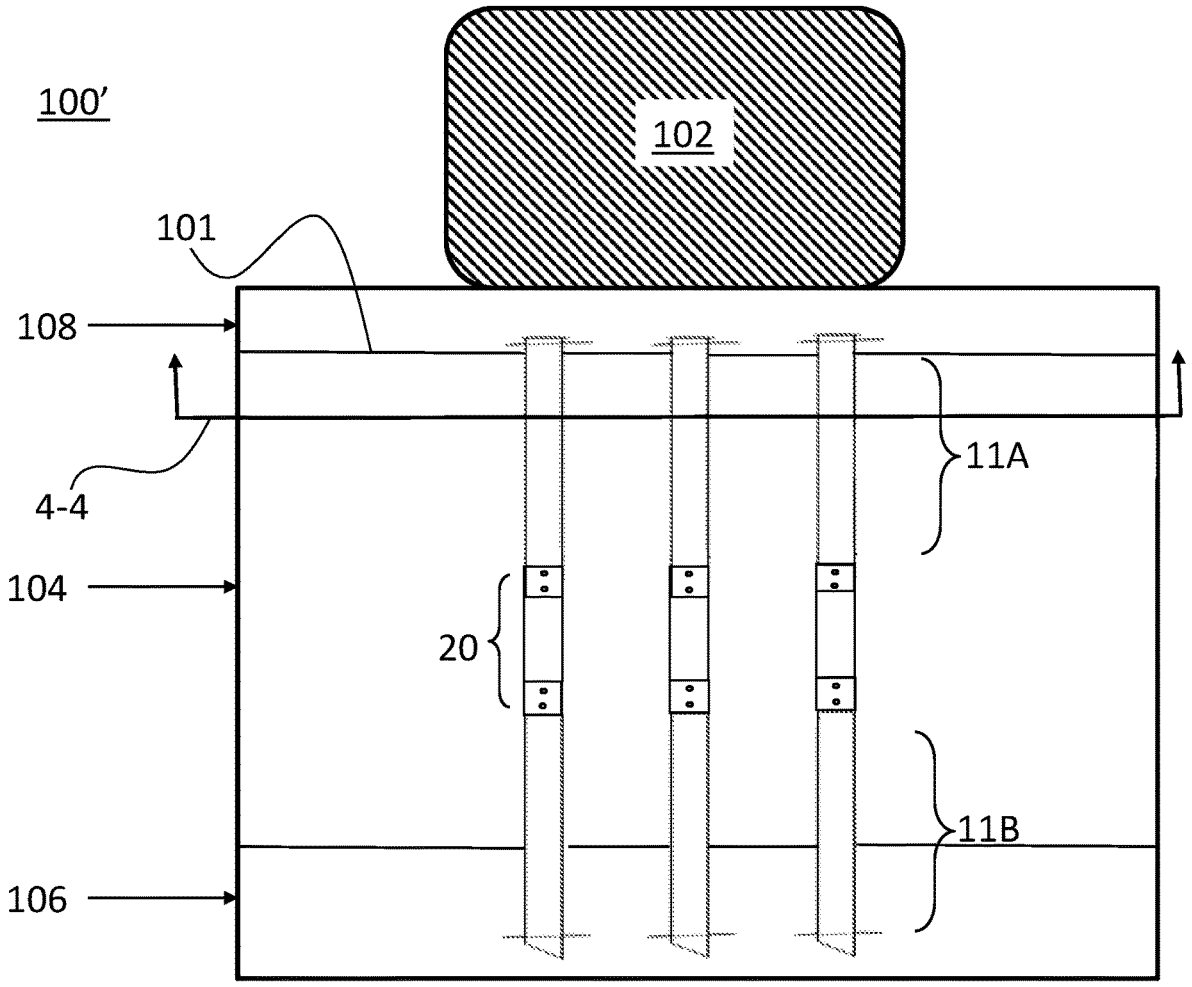
FIG. 4 shows a ground improvement system, according to embodiments of the present disclosure, wherein the helical rigid-inclusions include the extension member shown in FIG. 3.

FIG. 4 shows a ground improvement system 100' that includes multiple helical rigid-inclusions 10 that each comprise the extension member 20, wherein the object 102 is located above a compressible layer 104' that has such a thickness that extensions 20 are used. Each of helical rigid-inclusions 10 and each extension member 20 are designed to support at least a portion of the object 102 by transferring to the bearing layer 106 at least a portion of the load force generated by the object 102 upon the load transfer platform 108. In some embodiments of the present disclosure, the distance between the surface and the bearing layer 106 may necessitate more than one extension 20 being used for each helical rigid-inclusion 10. For example, at least two, or three or more extension members 20 can be used to reach, or exceed, a total length about 30 feet, or less. The person skilled in the art will appreciate that the references below to the system 100 may also include references to the system 100'.

Figure 5A:
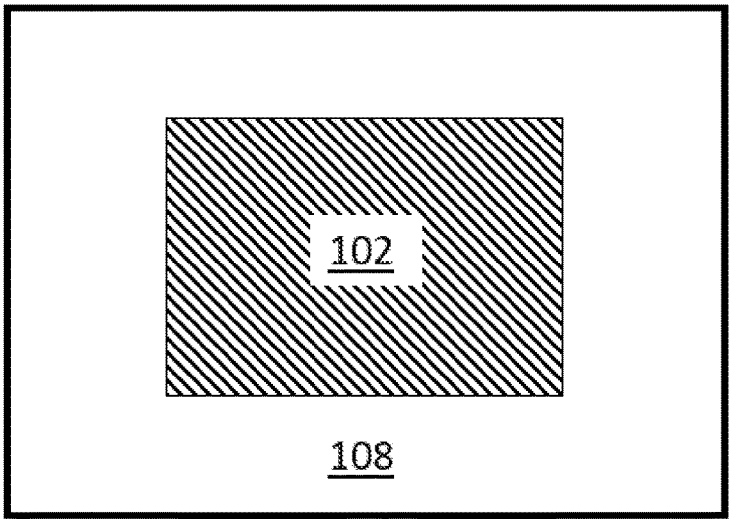
FIG. 5A is a top-plan view of the system; and, FIG. 5B is a bottom plan view taken through line 4-4 of FIG. 4.
Figure 5B:
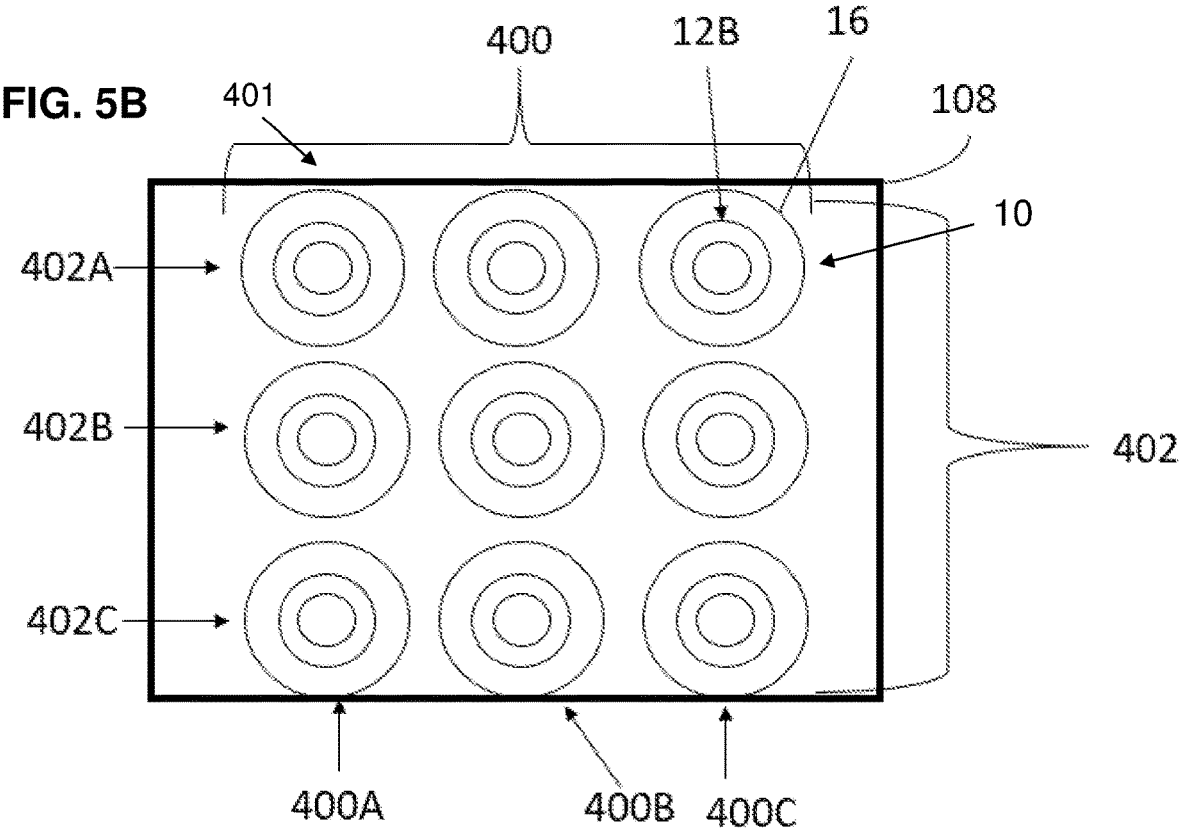

FIG. 5A shows a top plan view of the system 100 from FIG. 3. In this non-limiting view, the load transfer platform 108 is shown has having a larger foot print than the object 102. The person skilled in the art will appreciate that the load transfer platform 108 may also have a footprint of substantially the same size, or smaller, than the footprint of the object 102. FIG. 5B shows the second end 12B of a number of helical rigid-inclusions 10. From this view, it is apparent that the system 100 may include an array 401 that comprises one or more columns 400 of helical rigid-inclusions 10 and one or more rows 402 of helical rigid-inclusions 10. In the non-limiting example of FIG. 5B, three columns 400A, 400B and 400C are shown and three rows are shown 402A, 402B and 402C. The number of columns 400 and rows 402 that are utilized and the total number of rigid helical inclusions 10 used may depend on a variety of factors, including, but not limited to: the mass of the object 102, the footprint of the object 102, the mass of the load transfer platform 108, the foot print of the load transfer platform 108, the depth of the compressible layer 104, the compressibility of the compressible layer 104, the stability of the bearing layer 106, the local climate and freeze/thaw cycles and combinations thereof. Furthermore, while FIG. 5B shows the array 401 as being arranged in an equal number of columns 400 and rows 402, that is not a requirement so long as the system 100 can provide support the object 102, which may be of various shapes and footprints, when viewed from above.

Figure 6A:
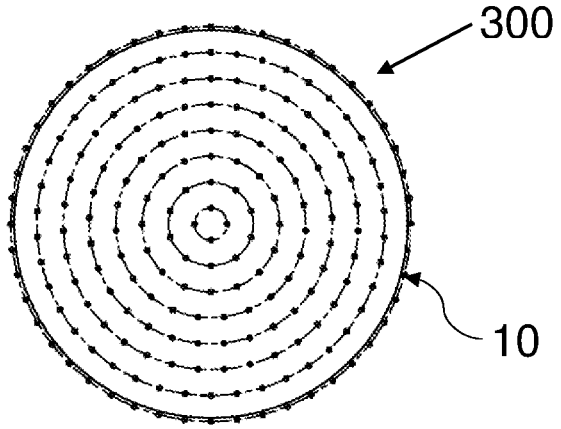
FIG. 6A is a top plan view of the system.

FIG. 6 shows a ground improvement system 600 that comprises an array 300 of multiple helical rigid-inclusions 10 according to embodiments of the present disclosure. FIG. 6A shows a top-plan view of the system 600 wherein the array 300 comprises multiple helical rigid-inclusions 10 are arranged to define multiple circles. As will be appreciated by those skilled in the art, the array 300 comprises one single circle or there may be multiple circles of helical rigid-inclusions 10. In some embodiments of the present disclosure, the distance between helical rigid-inclusions 10 along the curvature of each circle's circumference may be between about 5 feet and about 20 feet. In some embodiments of the present disclosure, the distance may be between about 8 feet and about 12 feet. In some embodiments of the present disclosure, the distance is about 8 feet. The person skilled in the art will appreciate that the distance between each of the circles need not be equal nor are the circles required to be concentric. Furthermore, the positioning of the multiple helical rigid-inclusions 10 on each circle of the array 300 may be evenly spaced about the circumference, or not, and each circle may have the same number of helical rigid-inclusions 10, or not.

Figure 6B:
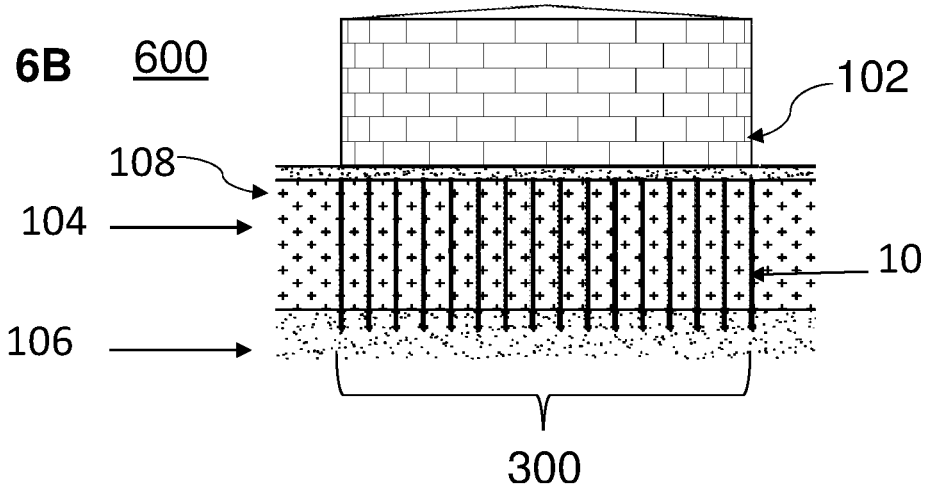
FIG. 6B is a side-elevation view of the system wherein; and, FIG. 6C is a side-elevation view of the system, wherein the helical rigid-inclusions are battered at an angle from true vertical.
Figure 6C:
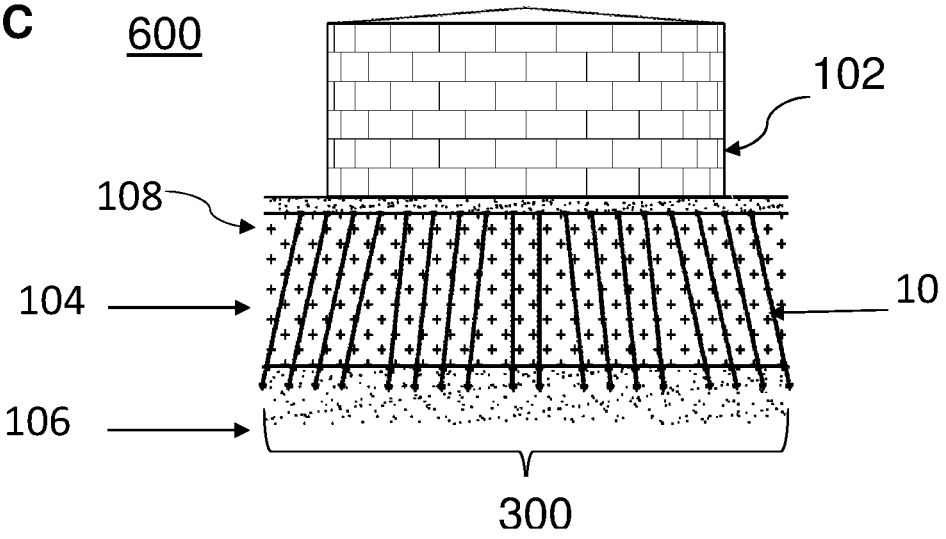

FIG. 6B shows a side elevation view of the system 600 comprising the array 300 with multiple helical rigid-inclusions 10 arranged to define the circumference of multiple circles. In some embodiments of the present disclosure, the multiple helical-rigid inclusions 10 are installed in a substantially vertical orientation. FIG. 6C shows another embodiment of the present disclosure wherein at least some of the helical rigid-inclusions 10 within the array 300 are battered at an angle from true vertical. The battering of the helical rigid-inclusions 10 will increase their lateral load bearing capacity if lateral load forces are anticipated to be exerted upon the object 102. In some embodiments of the present disclosure, the object 102 supported by the system 600 may be a tank or equivalent storage structure. In some embodiments of the present disclosure, the diameter of the object 102 may be about 50 feet to about 400 feet. In some embodiments of the present disclosure, the diameter of the object 102 may be about 100 feet to about 175 feet. In some embodiments of the present disclosure, the diameter of the object 102 may be about 120 feet to about 150 feet.

Figure 7A:
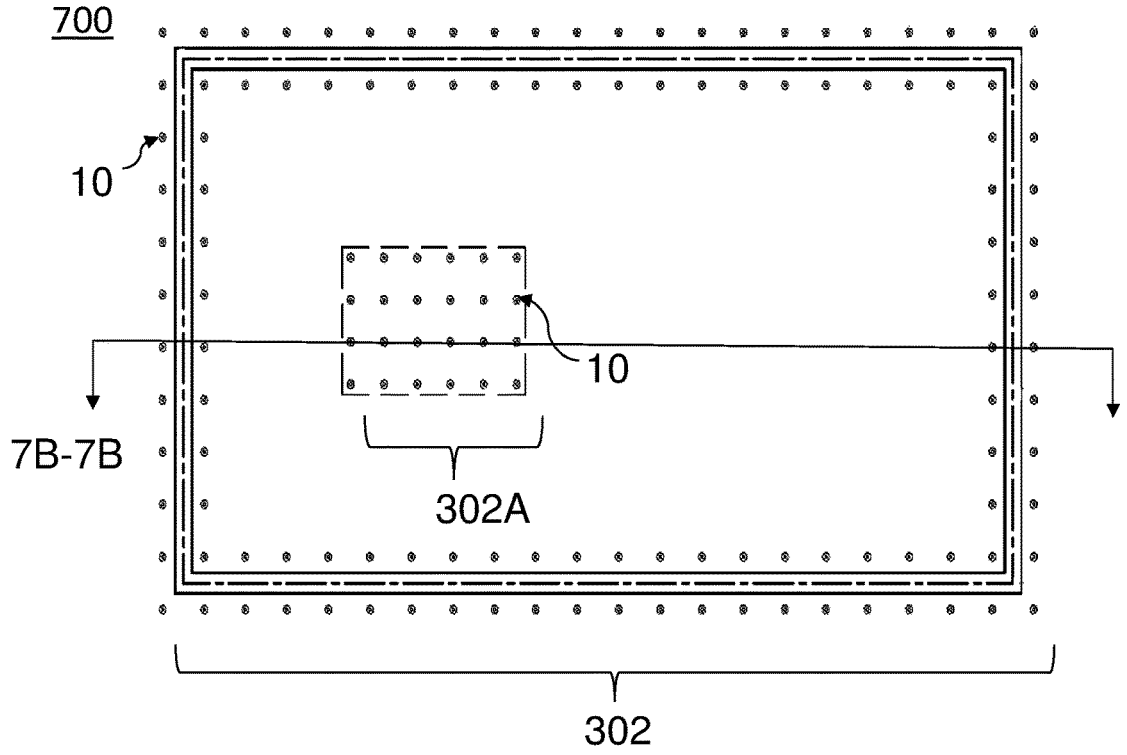
FIG. 7A is a top plan view of the system; and, FIG. 7B is a cross-sectional view of the system taken through line 7-7 of FIG. 7A.
Figure 7B:
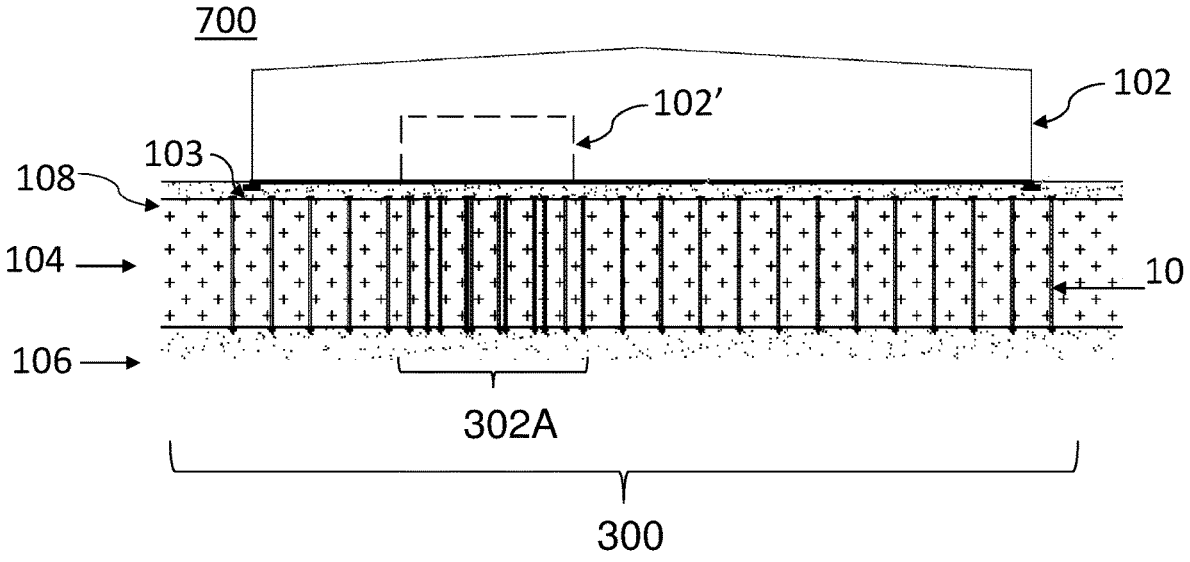

FIG. 7 shows a ground improvement system 700 that comprises multiple helical rigid inclusions 10 arranged in an array 302 and a sub-array 302A. FIG. 7A is a plan view of a non-limiting example of the system 700. In some embodiments of the present disclosure, the array 302 comprises multiple helical rigid-inclusions 10 arranged to define a rectangle and the multiple rigid-inclusions 10 arranged within the sub-array 302A may also define a rectangle. The multiple helical rigid-inclusions 10 of the sub-array 302A may be arranged at a distance to support a localized object 102' within the array 302. In some embodiments of the present disclosure, the helical rigid-inclusions 10 of the array 300 in the system 700 may be arranged in paired rows. In some embodiments of the present disclosure, each row of the paired rows may be arranged on either side of a centerline of a shallow foundation 103. In some embodiments of the present disclosure, the shallow foundation is a strip-footing. In some embodiments of the present disclosure, the distance between the multiple helical rigid-inclusions 10 of the array 302 and the sub-array 302A may be about 5 feet and about 20 feet. In some embodiments of the present disclosure, the distance between the multiple helical rigid-inclusions 10 of the system 700 may be between about 8 feet and about 15 feet. In some embodiments of the present disclosure, the distance between the multiple helical rigid-inclusions 10 of the array 302 is about 12 feet and distance between the multiple helical rigid-inclusions 10 of the sub-array 302A is about 8 feet. The person skilled in the art will appreciate that the distance between each of the paired rows of helical rigid-inclusions 10, in either the array 302 or the sub-array 302A need not be equal. Furthermore, the multiple helical rigid-inclusions 10 may be evenly spaced about the perimeter, or not. FIG. 7B shows a cross-section view of the system 700. In some embodiments of the present disclosure, the object 102 may be a building or any other structure with a shallow foundation. In some embodiments of the present disclosure, the localized object 102' can be a storage rack, a machine, or any other object that is concentrated in a defined area.

Figure 8A:
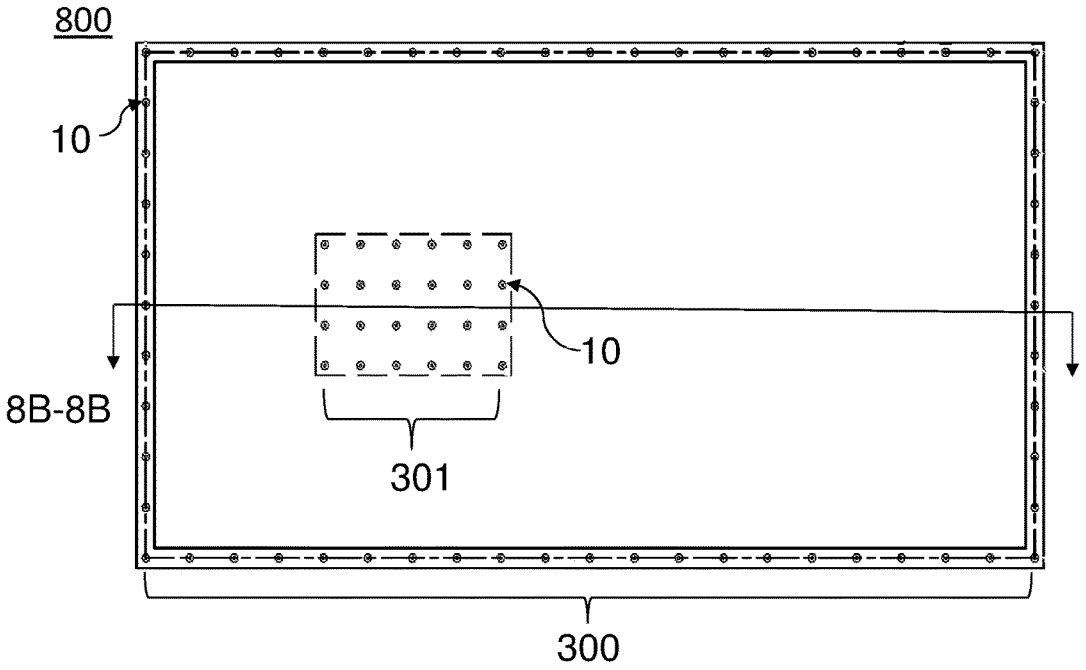
FIG. 8A is a top plan view of the system; and, FIG. 8B is a cross-sectional view of the system taken through line 8-8 of FIG. 8A.
Figure 8B:
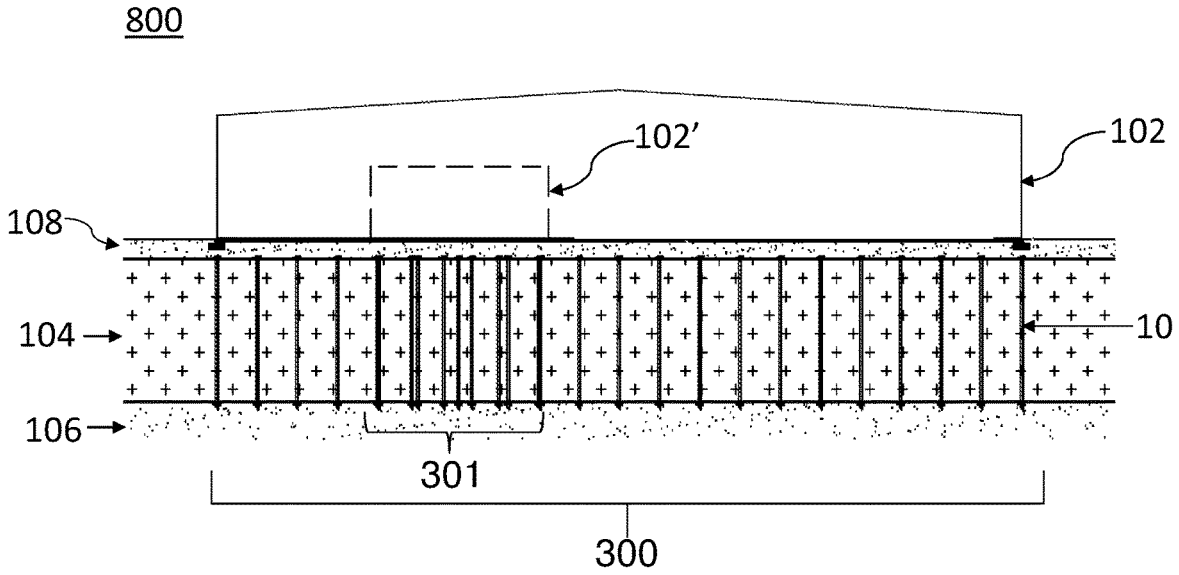

FIG. 8A and FIG. 8B show a ground improvement system 800 that is similar to the system 700. At least one difference is that the array 300 comprises a single line of multiple helical rigid-inclusions 10 arranged to define a rectangle. In the non-limiting example of the system 800, the helical rigid-inclusions 10 may be arranged at a location substantially directly below a centerline of a shallow foundation. In some embodiments of the present disclosure, the shallow foundation is a strip-footing.

Figure 9A:
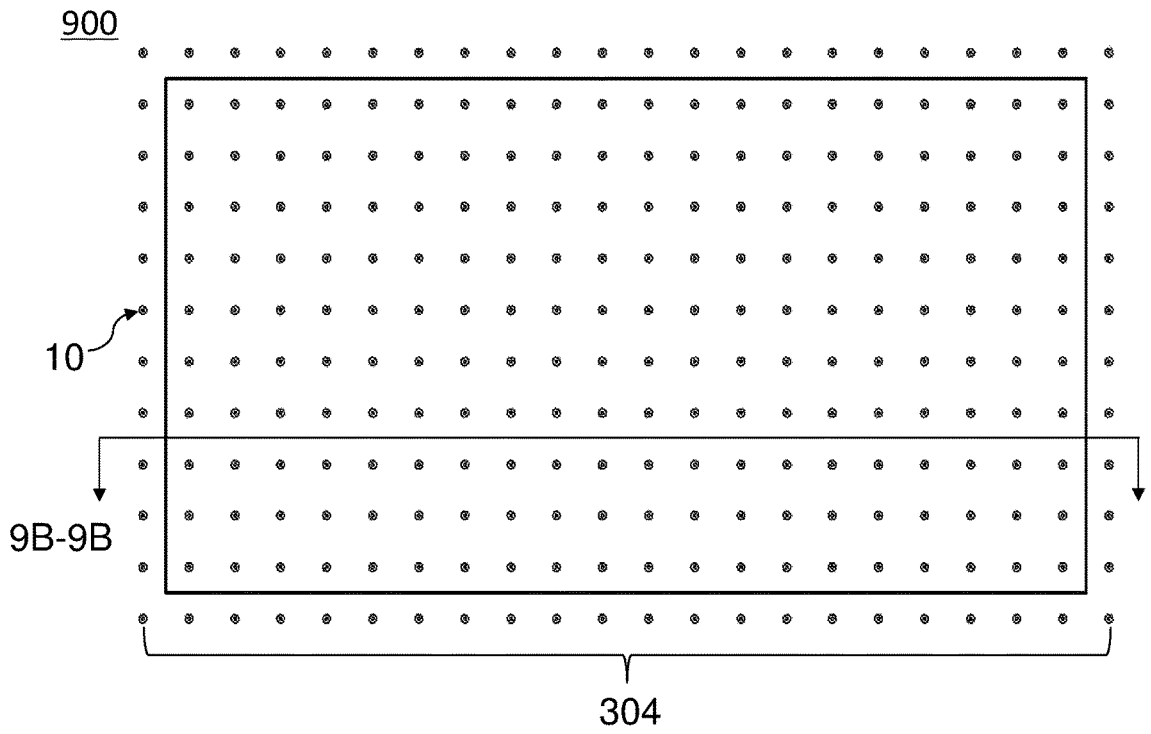
FIG. 9A is a top plan view of the system; and, FIG. 9B is a cross-sectional view of the system taken through line 9-9 of FIG. 9A.
Figure 9B:
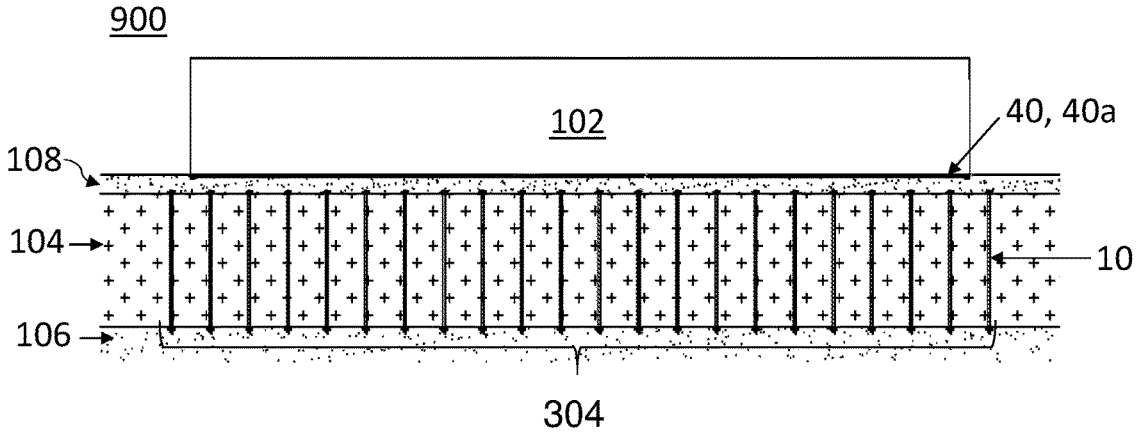

FIG. 9 shows a ground improvement system 900 that comprises multiple helical rigid inclusions 10 arranged in an array 304. FIG. 9A shows a plan view of the array 304 comprising multiple helical rigid-inclusions 10 arranged at a distance in rows and columns to define a rectangle. In some embodiments of the present disclosure, the distance between the helical rigid-inclusions 10 may be between about 5 feet and about 20 feet. In some embodiments of the present disclosure, the distance between the helical rigid-inclusions 10 may be between about 8 feet and about 15 feet. In one embodiment of the present disclosure, the distance between the helical rigid-inclusions 10 is about 10 feet. The person skilled in the art will appreciate that the distance between the helical rigid-inclusions 10 within each of the rows (or columns) need not be equal. Furthermore, the positioning of the multiple helical rigid-inclusions 10 may be evenly spaced about the perimeter, or not. FIG. 9B shows an elevation view of an embodiment of the system 900, wherein the object 102 comprises a concrete foundation 40. In some embodiments of the present disclosure, the object 102 is a warehouse or similar structure. In some embodiments of the present disclosure, the concrete foundation 40 is slab-on-grade 40*a*. In some embodiments of the present disclosure, the array 300 extends past the perimeter of the object 102.

Figure 10A:
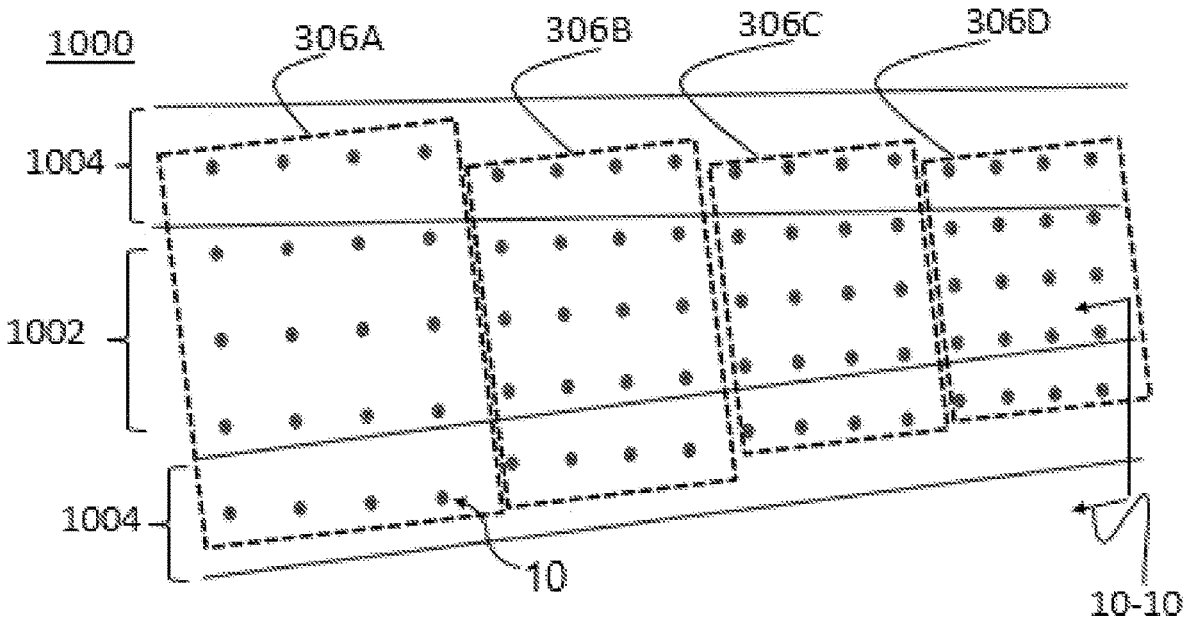
FIG. 10A is a top plan view of the system; and, FIG. 10B is a cross-sectional view of the system taken through line 10-10.
Figure 10B:
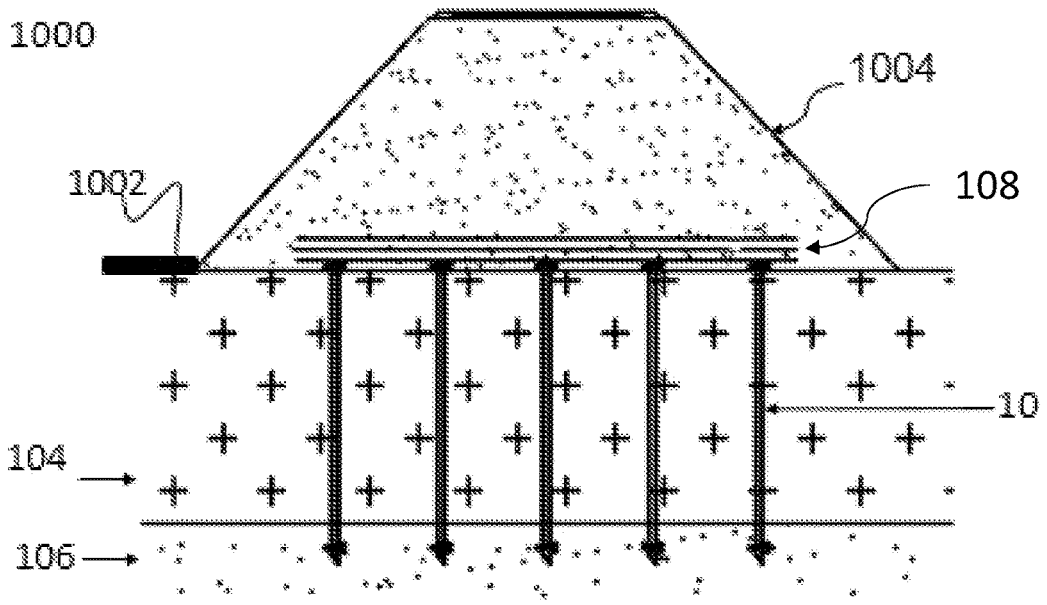

FIG. 10A shows a ground improvement system 1000 that comprises an array 306 of multiple helical rigid-inclusions 10. The array 306 is configured to support an object 1002, such as a roadway, highway, freeway, toll-road and the like, that is positioned above a compressible layer 104 (see FIG. 10B). The array 306 is also configured to support another object 1004, such as an embankment or other formation made of soil, rock or recycled materials, which may include within it a layer or multiple layers of geotextile, geosynthetic material, steel reinforcement mesh or combinations thereof. The multiple helical rigid-inclusions 10 of the array 306 can be arranged to accommodate the positioning, size and path of travel of the object 1002. In some embodiments of the present disclosure, the system 1000 comprises multiple sub-arrays which use varying HRI configurations and spacings to suit the different loading conditions which may occur at various areas of the footprint of the object 1002. For example, if the design height of an embankment becomes greater along its path of travel, so too may the load force generated be increased. This increased load force may require the helical rigid-inclusions 10 in that area of the embankment's footprint to have a greater load capacity or to be more closely spaced, or, a load transfer platform 108 may be incorporated or altered to provide better load transfer to the helical rigid inclusions 10. Sub-array's 306A, 306B, 306C and 306D are shown to illustrate the possibility of using multiple different helical rigid inclusion designs or spacings to suit different loading conditions which may exist within a common structure or embankment. object 1002.

Figure 11:
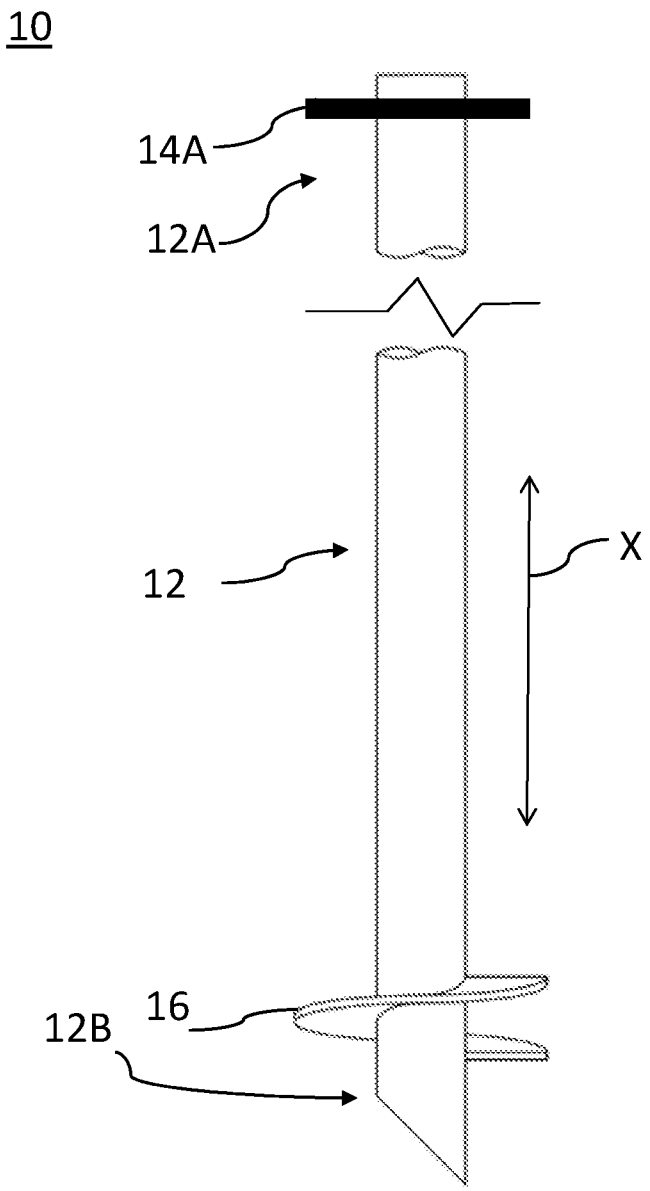
FIG. 11 shows a side elevation view of the helical rigid-inclusion from FIG. 1A, according to a further embodiment of the present disclosure.

FIG. 11 shows another non-limiting example of a helical rigid-inclusion 10 with a top member 14A that defines opposite planar surfaces that are arranged to extend substantially perpendicular from a longitudinal axis of the elongate body 12 (see line X in FIG. 1A and FIG. 11). The skilled person will appreciate that the top member 14A may also be used with the other embodiments of helical rigid-inclusions described herein above. The top member 14A may be operatively coupled to the first end 12A of the elongate body 12 by one or more connection members, such as a pin, bolt, shank or other type of connection member that can operatively couple the top member 14A to the first end 12A. In some embodiments of the present disclosure, the top member 14A can be operatively coupled to the first end 12A by an extension member (not shown) that extends substantially perpendicular from one of the planar surfaces of the top member 14A for receipt within or about the second end 14A. Alternatively, the second end 12A may include a sleeve (not shown) that can be received by a portion of the top member 14A. In some embodiments of the present disclosure, the top member 14A may be positioned upon the first end 12A and not directly connected thereto. For example, if the helical rigid-inclusion 10 is already positioned within the soil with a least a portion of the first end 12A proximal to the surface 101 and before when a load transfer platform 108 is deployed, the top member 14A may be placed upon the first end 12A and the load transfer platform 108 can be deployed thereupon.

FIG. 12A shows one example of a drive tool 2000 that may be used for installing and removing the helical rigid-inclusions 10 of the present disclosure. The drive tool 2000 comprises a top plate 2002, a shank 2004 and an engaging member 2006 that is arranged about the shank 2004 below the top plate 2002. The top plate 2002 is configured to operative couple with a rotary drive mechanism of the equipment being used to install (and remove) the helical rigid-inclusion 10 so that rotating the rotary drive mechanism causes the drive tool 2000 to rotate also. The shank 2004 is connected at one end to the top plate and extends away substantially perpendicular from the top plate 2002. The shank 2004 defines a tip 2008 that is opposite to the top plate 2002. The tip 2008 may be frustoconcial, or otherwise shaped to facilitate entry of the shank 2004 into the first end 12A of the helical rigid-inclusion 10 (as shown in FIG. 12B).

The engaging member 2006 is also connected at one end to the top plate 2002 and extends away therefrom, about the shank 2004. The engaging member 2006 defines a slot 2010 and a shoulder 2012. The slot 2010 extends in a helical path about the shank 2004 between proximal to the tip 2008 and proximal to the top plate 2002. The shoulder 2012 is positioned at the end of the slot 2010 that is proximal to the top plate 2002.

Figure 13:
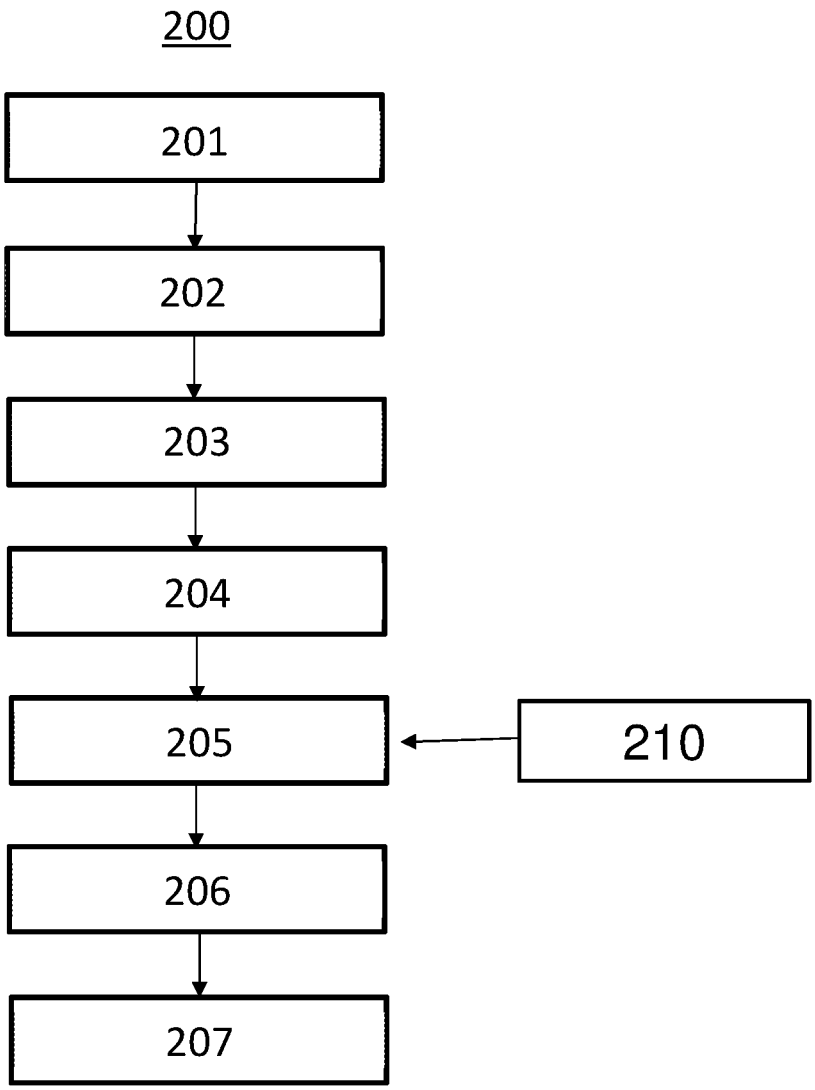
FIG. 13 shows a logic process flow of a method of installing the ground improvement system, according to embodiments of the present disclosure.

FIG. 13 shows a sequence of steps that make up a method 200 of installing a ground improvement system of the present disclosure.

The method 200 comprises a step 201 of attaching the helical rigid-inclusion 10 to a rotary drive mechanism that may be attached to a hydraulic excavator or to another piece of construction equipment with similar functionality. The helical rigid-inclusion 10 can be attached to the rotary drive mechanism by use of the drive tool 2000. In use, the drive tool 2000 is positioned proximal the first end 12A of the helical rigid-inclusion 10 and the drive tool 2000 is then moved so that the tip 2008 is received within the first end 12A. Next the rotary drive mechanism can rotate until a trailing edge 14C of the top member 14 is received within the slot 2010. Continued rotation of the drive tool 2000 causes the top member 14 to move through the slot 2010 until the trailing edge 14C abuts the shoulder 2012. At that position, further rotation of the drive tool 2000 will rotate the entire helical rigid-inclusion 10. In other embodiments of the present disclosure, another form of drive tool may be used that is received about the first end 12A (rather than within) of the helical rigid-inclusion 10.

Step 202 comprises positioning a rotary drive mechanism above a surface at a desired location for installing a helical rigid-inclusion 10.

Step 203 comprises exerting a torsional force from the rotary drive mechanism into the helical rigid-inclusion 10 to initiate rotation and downward advancement of the helical rigid-inclusion 10 below the surface. In some embodiments of the present disclosure, the torsional force may be applied by bearing against the trailing edge 14C of the top member 14.

The method 200 further comprises a step 204 of advancing the helical rigid-inclusion 10 through the compressible layer 104 to the bearing layer 106 using the torsional force and a downward linear force. In some embodiments of the present disclosure, the downward linear force may be exerted by the hydraulic excavator or another piece of construction equipment.

Step 205 comprises disconnecting the helical rigid-inclusion from the rotary drive mechanism and retracting the rotary drive mechanism to a location above the surface.

Step 206 of the method further comprises repeating steps 201 to steps 205 until all of the desired helical rigid-inclusions 10 of the ground improvement system 100 are installed in order to support the object 102 or a portion thereof.

Step 207 comprises installing the load transfer platform 108 above the compressible layer 104, the load transfer platform 108 is configured to transfer a force exerted by the object 102 upon the surface, or a portion thereof, to the helical rigid-inclusions 10 therebelow.

FIG. 11 also shows an optional step 210 of coupling an extension member 20 to an upper portion of the helical rigid-inclusion 10 that is at least partially below the surface, or not. Step 210 can be useful when the depth of the compressible layer 104 exceeds the length of each helical rigid-inclusion 10 used in the system 100. The method 200 may also further comprise a step of repeating steps 201 to 206 (and optionally step 207) so as to form an array of helical rigid-inclusions 10, where such array is configured to support an object and/or any resulting lateral load forces that the object exerts upon a compressible layer.

The invention claimed is:

1. A system for reinforcing a compressible soil strata, the system comprising:

(a) an array of helical rigid-inclusions, wherein each helical rigid-inclusion comprises an elongate body, a top member located proximal to a first end of the elongate body, and at least one lower helically formed member secured to a second end of the elongate body that is arranged opposite to the first end;

(b) a load transfer platform configured to transfer at least a portion of a load force from an object upon an upper surface of the load transfer platform to the at least one helical rigid-inclusion, wherein the load transfer platform comprises a granular material, wherein the top member is spaced from the object; and (c) a drive tool configured for installation and removal of the helical rigid-inclusions having a shank and an engaging member that is arranged about the shank, wherein the shank defines a tip shaped to facilitate entry of the shank into the first end of the elongate body, wherein the engaging member defines a helical slot, and wherein the engaging member includes a shoulder positioned at an end of the helical slot.

2. The system of claim 1, wherein the top member is helical.

3. The system of claim 2, wherein the top member is connected to the first end.

4. The system of claim 1, wherein the top member is substantially planar.

5. The system of claim 4, wherein the top member is connectible to the first end.

6. The system of claim 1, wherein at least one of the top member and the at least one lower helically formed member have a diameter between about 7 inches and about 45 inches.

7. The system of claim 1, wherein at least one of the top member and the at least one lower helically formed member has a thickness between about 0.2 inches and about 2 inches.

8. The system of claim 1, wherein the at least one helical rigid-inclusion is couplable to a rotary drive mechanism for installing the at least one helical rigid-inclusion below a surface.

9. The system of claim 1, wherein the elongate body has an outer diameter between about 1.5 inches to about 18 inches.

10. The system of claim 1, wherein the elongate body is hollow and has a wall thickness of between about 0.1 inches to about 1.2 inches.

11. The system of claim 1, wherein the at least one helical rigid-inclusion is further configured to be reversibly connectible to an extension member between the top member and the at least one lower helically-formed member.

12. The system of claim 1, wherein the load transfer platform further comprises at least one layer of one or both of an embedded geotextile and a geosynthetic material.

13. The system of claim 1, wherein the load transfer platform has a thickness of between about 1 foot and about 5 feet.

14. The system of claim 1, wherein the load is positioned upon a shallow foundation or a slab-on-grade, each of which is positioned above the array of helical rigid inclusions, within or on top of the load transfer platform.

15. The system of claim 1, further comprising a drive tool that is configured for operatively coupling the first end of the at least one helical-rigid inclusion to a rotary drive mechanism.

16. The system of claim 1, further comprising a second lower helically-formed member.

17. The system of claim 1, wherein the top end of the elongate body is positioned within a lower portion of the load transfer platform.

18. The system of claim 1, wherein the top end of the elongate body is positioned below the load transfer platform.

19. A drive tool configured for installation and removal of helical rigid-inclusions of a system for reinforcing compressible soil strata, wherein each helical rigid-inclusion comprises an elongate body, a top member located proximal to a first end of the elongate body, and at least one lower helically-formed member secured to a second end of the elongate body that is arranged opposite to the first end, the drive tool comprising:

a shank; and an engaging member that is arranged about the shank, wherein the shank defines a tip arranged shaped to facilitate entry of the shank into the first end of the elongate body, wherein the engaging member defines a helical slot, and wherein the engaging member includes a shoulder positioned at an end of the helical slot.

* * * * *